US006015073A

United States Patent [19]

Wojciak et al.

[11] Patent Number: 6,015,073

[45] Date of Patent: Jan. 18, 2000

[54] SAFETY UTILITY BELT

[76] Inventors: Jeffery J. Wojciak, 7438 S. Beloit; David Lis, 6928 Elder Ct.; Timothy Landingham, 9019 Failane Dr., all of Bridgeview, Ill. 60455

[21] Appl. No.: 09/168,581

[22] Filed: Oct. 8, 1998

[51] Int. Cl.[7] ..... A45F 5/00

[52] U.S. Cl. ..... 224/251; 224/660; 224/250; 224/197; 224/904; 2/312

[58] Field of Search ..... 224/242, 250, 224/251, 255, 269, 660, 663, 664, 197, 904; 2/300, 301, 311–315, 319, 247, 252

[56] References Cited

U.S. PATENT DOCUMENTS

| | | | |
|---|---|---|---|
| 1,486,470 | 3/1924 | Welch | 224/664 X |
| 1,642,911 | 9/1927 | Thurnau | 224/269 X |
| 4,676,419 | 6/1987 | Victor | 224/269 X |
| 4,751,923 | 6/1988 | Marino | 128/94 |
| 4,819,846 | 4/1989 | Hannemann | 2/312 X |
| 4,923,105 | 5/1990 | Snyder | 224/255 |
| 5,004,136 | 4/1991 | Leath . | |
| 5,151,678 | 9/1992 | Veltri et al. | 362/103 |
| 5,201,448 | 4/1993 | Schue . | |
| 5,292,042 | 3/1994 | Yamaguchi et al. | 224/663 X |
| 5,413,262 | 5/1995 | Dewire et al. . | |
| 5,464,136 | 11/1995 | Eddy | 2/312 X |
| 5,511,703 | 4/1996 | Ryerson . | |
| 5,941,438 | 8/1999 | Price | 224/660 X |

FOREIGN PATENT DOCUMENTS

| | | | |
|---|---|---|---|
| 1504764 | 12/1967 | France | 2/313 |
| 90591 | 1/1968 | France | 2/312 |
| 320529 | 8/1934 | Italy | 2/315 |

*Primary Examiner*—Gregory M. Vidovich
*Attorney, Agent, or Firm*—Joseph N. Breaux

[57] ABSTRACT

A safety utility belt that includes a number of retaining rings each provided with a safety cover flap securable over the retaining ring to prevent snagging of the retaining ring. The safety utility belt includes a heavy duty webbing back belt, a reflective center belt strip, a buckle assembly, a belt strip end that is coupleable to the buckle assembly to secure the back belt about the waist of a user, a horizontally pivoting tool retaining ring, a no-snag tool retaining ring safety cover flap securable over the tool retaining ring to prevent snagging of the tool retaining ring, a vertically pivoting attached D-ring, and a no-snag D-ring safety cover flap securable over the D-ring to prevent snagging of the D-ring. The no-snag tool retaining ring safety cover flap and the no-snag D-ring safety cover flap include a storage hook and pile fastener strip that is securable to a companionate section of hook and pile fastener material provided on a back side surface of the back belt when the no-snag tool retaining ring safety cover flap is folded backward against the back side of the back belt in a no-snag storage position.

1 Claim, 2 Drawing Sheets

SAFETY UTILITY BELT

TECHNICAL FIELD

The present invention relates to utility belts for carrying tools and the like and more particularly to a safety utility belt that includes a number of attachment rings that are each provided with a safety cover flap securable over the attachment structure to minimize dangerous snagging of the utility belt when working in confined areas or when in an emergency situation such as while performing firefighting activities; the safety utility belt including a heavy duty webbing back belt, a reflective center belt strip, a buckle assembly, a belt strip end that is coupleable to the buckle assembly to secure the back belt about the waist of a user, a horizontally pivoting tool retaining ring, a no-snag tool retaining ring safety cover flap securable over the tool retaining ring to prevent snagging of the tool retaining ring, a vertically pivoting attached D-ring, and a no-snag D-ring safety cover flap securable over the D-ring to prevent snagging of the D-ring; the no-snag tool retaining ring safety cover flap and the no-snag D-ring safety cover flap including a storage hook and pile fastener strip securable to a back side surface of the back belt when the no-snag tool retaining ring safety cover flap is folded backward against the back side of the back belt in a no-snag storage position.

BACKGROUND ART

While in many jobs, such as firefighting and the like, it is desirable to attach tools of the trade, such as axes, flashlights, hammers, snips, etc, to a utility belt using a number of retaining rings, the retaining rings on the utility belt can sometimes become snagged while in the work environment and lead to injury or death for the worker. It would be a benefit, therefore, to have a utility belt that included a number of retaining rings for securing desirable tools to the utility belt as need that further included a cover flap for each of the retaining rings so that all unused retaining rings could be covered to prevent snagging of the retaining ring and possible death or injury to a user.

GENERAL SUMMARY DISCUSSION OF INVENTION

It is thus an object of the invention to provide a safety utility belt that includes a number of retaining rings each provided with a safety cover flap securable over the retaining ring to prevent snagging of the retaining ring.

It is a further object of the invention to provide a safety utility belt that includes a heavy duty webbing back belt, a reflective center belt strip, a buckle assembly, a belt strip end that is coupleable to the buckle assembly to secure the back belt about the waist of a user, a horizontally pivoting tool retaining ring, a no-snag tool retaining ring safety cover flap securable over the tool retaining ring to prevent snagging of the tool retaining ring, a vertically pivoting attached D-ring, and a no-snag D-ring safety cover flap securable over the D-ring to prevent snagging of the D-ring; the no-snag tool retaining ring safety cover flap and the no-snag D-ring safety cover flap including a storage hook and pile fastener strip securable to a back side surface of the back belt when the no-snag tool retaining ring safety cover flap is folded backward against the back side of the back belt in a no-snag storage position.

It is a still further object of the invention to provide a safety utility belt that accomplishes some or all of the above objects in combination.

Accordingly, a safety utility belt is provided. The safety utility belt includes a heavy duty webbing back belt, a reflective center belt strip, a buckle assembly, a belt strip end that is coupleable to the buckle assembly to secure the back belt about the waist of a user, a horizontally pivoting tool retaining ring, a no-snag tool retaining ring safety cover flap securable over the tool retaining ring to prevent snagging of the tool retaining ring, a vertically pivoting attached D-ring, and a no-snag D-ring safety cover flap securable over the D-ring to prevent snagging of the D-ring; the no-snag tool retaining ring safety cover flap and the no-snag D-ring safety cover flap including a storage hook and pile fastener strip securable to a back side surface of the back belt when the no-snag tool retaining ring safety cover flap is folded backward against the back side of the back belt in a no-snag storage position.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
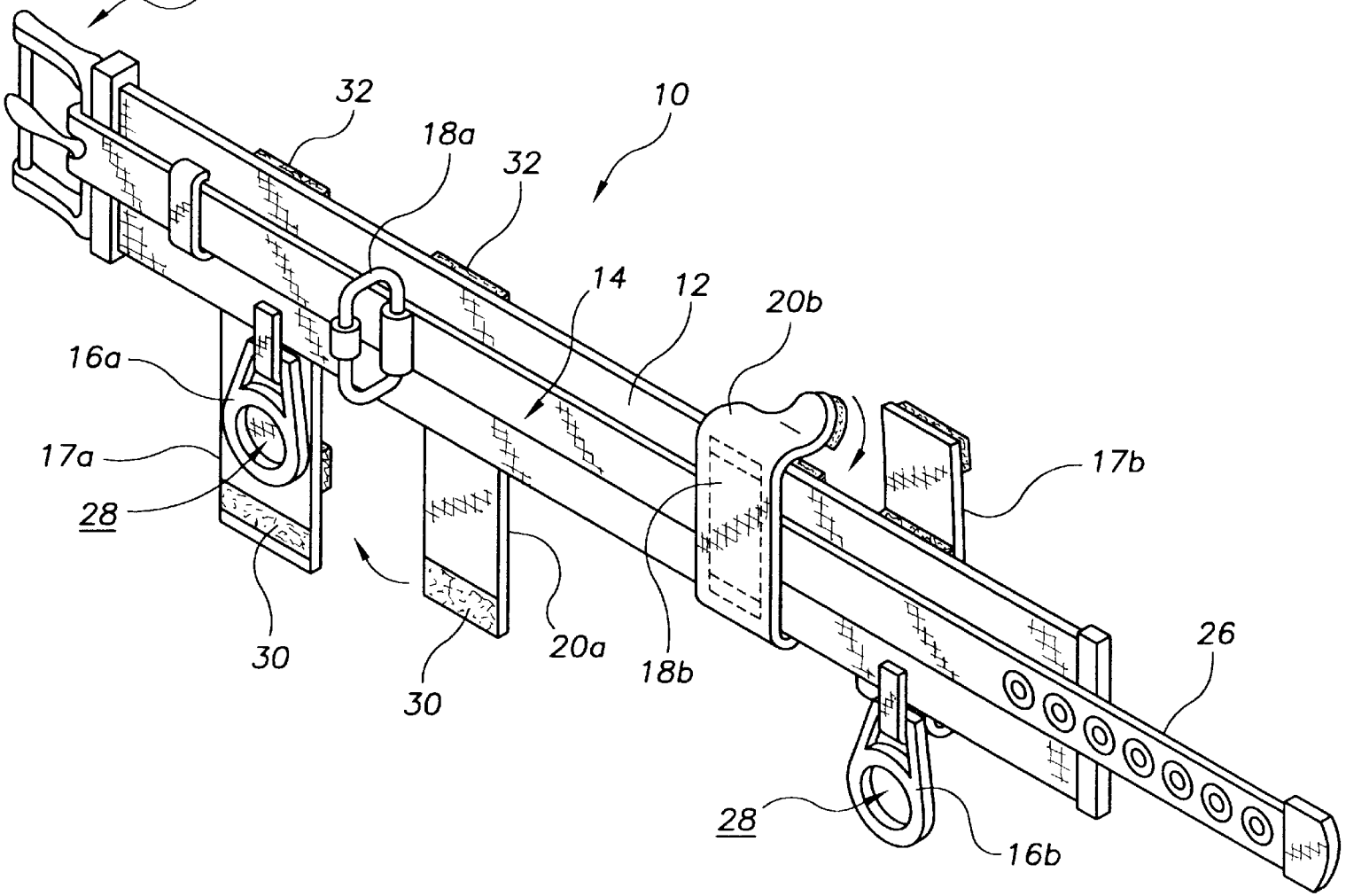
FIG. 1 is a perspective view of an exemplary embodiment of the safety utility belt of the present invention showing the heavy duty webbing back belt; the reflective center belt strip including the buckle assembly and the grommeted belt strip end; two exemplary horizontally pivoting tool retaining rings each including a no-snag tool retaining ring safety cover flap; and two identical vertically pivoting attached D-rings each including a no-snag D-ring cover flap, one of the no-snag D-ring cover flap shown secured over and concealing its respective D-ring.

FIG. 1 shows an exemplary embodiment of the safety utility belt of the present invention generally designated by the numeral 10. Safety utility belt 10 includes a heavy duty nylon webbing back belt 12; the reflective coating coated, center belt strip, generally designated 14; two horizontally pivoting tool retaining rings 16*a*,16*b*; two no-snag tool retaining ring safety cover flaps 17*a*,17*b*; two identical vertically pivoting attached D-rings 18*a*,18*b* (18*b* shown in dashed lines); and two no-snag D-ring cover flaps 20*a*,20*b*.

Center belt strip 14 includes a conventional buckle assembly generally designated 24, a belt strap end 26, that is coupleable to buckle assembly 24 to secure back belt 12 about the waist of a user. In this embodiment reflective coating is an aluminized coating material.

Figure 2:
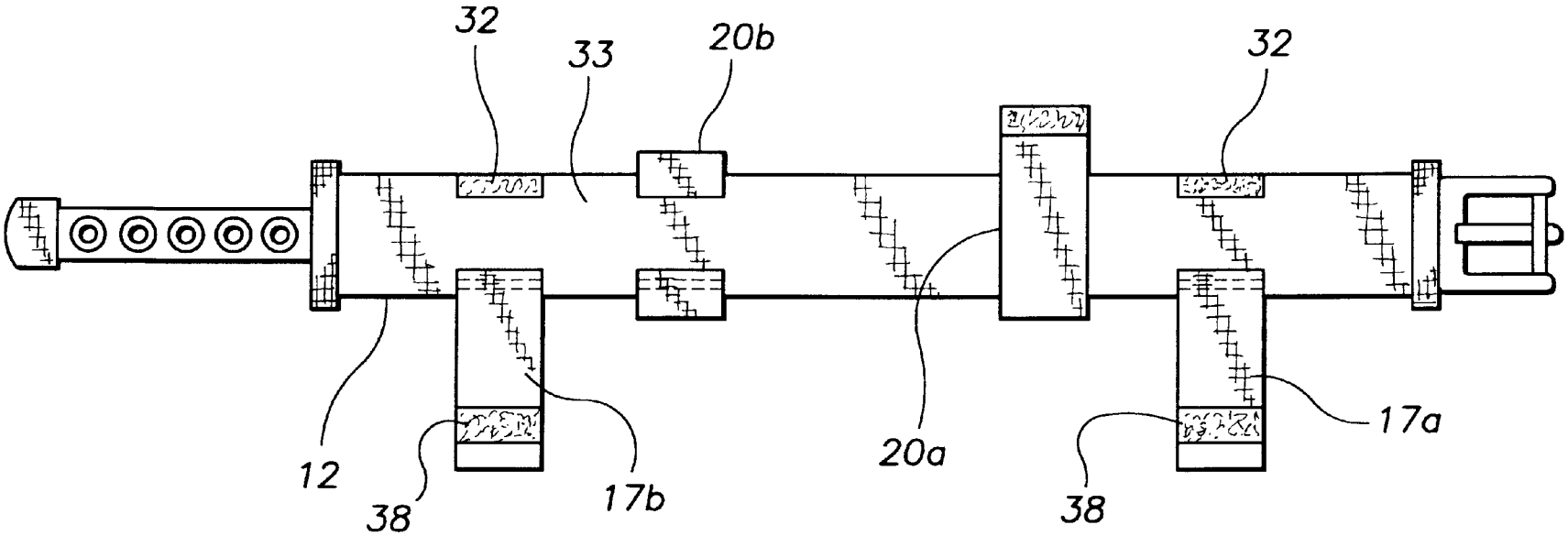
FIG. 2 is a backside plan view of the exemplary safety utility belt of FIG. 1 showing the heavy duty webbing back belt; the buckle assembly, the grommeted belt strip end, the two no-snag tool retaining ring safety cover flap in the down position, the two no-snag D-ring cover flaps—one of the no-snag D-ring cover flaps being secured over its respective D-ring the other being folded backwards and secured against the back side of the back belt in the no-snag storage position with the storage hook and pile fastener strip.

The two horizontally pivoting tool retaining rings 16*a*,16*b* are each constructed from stainless steel and have a circular tool receiving opening 28 through which a portion of a tool such as a flashlight, ax etc. is inserted to free the hands of the wearer. Each no-snag tool retaining ring safety cover flap 17*a*,17*b* and each no-snag D-ring cover flap 20*a*,20*b* is constructed from a fabric material and includes a first hook and pile section 30 at one end thereof that is companionate with, referring to FIG. 2, a back belt section 32 provided on a back side surface 33 of back belt 12 and a storage hook and pile fastener strip 38 that is also companionate with the back belt section 32. Storage hook and pile fastener strip 38 is attached to the back belt section 32 to secure safety cover flaps 16*a*,16*b*,17*a*,17*b* when folded backward against back side surface 33 of back belt 12 in a no-snag storage position.

It can be seen from the preceding description that a safety utility belt has been provided includes a number of retaining rings each provided with a safety cover flap secureable over the retaining ring to prevent snagging of the retaining ring; and that includes a heavy duty webbing back belt, a reflective center belt strip, a buckle assembly, a belt strip end that is coupleable to the buckle assembly to secure the back belt about the waist of a user, a horizontally pivoting tool retaining ring, a no-snag tool retaining ring safety cover flap securable over the tool retaining ring to prevent snagging of the tool retaining ring, a vertically pivoting attached D-ring, and a no-snag D-ring safety cover flap securable over the D-ring to prevent snagging of the D-ring; the no-snag tool retaining ring safety cover flap and the no-snag D-ring safety cover flap including a storage hook and pile fastener strip securable to a back side surface of the back belt when the no-snag tool retaining ring safety cover flap is folded backward against the back side of the back belt in a no-snag storage position.

It is noted that the embodiment of the safety utility belt described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A safety utility belt comprising:

a back belt;

a reflective center belt strip attached to a front surface of and along the length of said back belt;

a buckle assembly extending past a first end of said back belt and secured to one end of said belt strip;

a belt strip end extending past a second end of said back belt and unitarily formed with another end of said belt strip, said belt strip end including a number of openings therethrough for coupling with said buckle assembly to secure said back belt about the waist of a user;

a horizontally pivoting tool retaining ring coupled to said back belt;

a no-snag tool retaining ring safety cover flap having a first end secured to said back belt and being sized to be securable over said tool retaining ring in a manner to prevent snagging of said tool retaining ring;

a vertically pivoting attached D-ring coupled to said back belt; and a no-snag D-ring safety cover flap having an end secured to said back belt and sized to be securable over said D-ring in a manner to prevent snagging of said D-ring;

said no-snag tool retaining ring safety cover including a storage hook and pile fastener strip that is securable to a companionate section of hook and pile fastener material provided on a back side surface of said back belt when said no-snag tool retaining ring safety cover flap is folded backward against said back side of said back belt in a no-snag storage position;

said no-snag D-ring safety cover flap including a storage hook and pile fastener strip that is securable to another companionate section of hook and pile fastener material provided on said back side surface of said back belt when said no-snag D-ring safety cover flap is folded backward against said back side of said back belt in a no-snag storage position.

* * * * *